US010473118B2

(12) United States Patent
Orosa

(10) Patent No.: US 10,473,118 B2
(45) Date of Patent: Nov. 12, 2019

(54) CONTROLLED CONVERGENCE COMPRESSOR FLOWPATH FOR A GAS TURBINE ENGINE

(71) Applicant: Siemens Aktiengesellschaft, München (DE)

(72) Inventor: John A. Orosa, Palm Beach Gardens, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 255 days.

(21) Appl. No.: 15/329,264

(22) PCT Filed: Aug. 29, 2014

(86) PCT No.: PCT/US2014/053345
§ 371 (c)(1),
(2) Date: Jan. 26, 2017

(87) PCT Pub. No.: WO2016/032506
PCT Pub. Date: Mar. 3, 2016

(65) Prior Publication Data
US 2017/0204878 A1 Jul. 20, 2017

(51) Int. Cl.
*F04D 29/54* (2006.01)
*F01D 5/14* (2006.01)
(Continued)

(52) U.S. Cl.
CPC ..... *F04D 29/547* (2013.01); *F01D 5/143* (2013.01); *F04D 19/02* (2013.01); *F04D 19/028* (2013.01); *F04D 29/324* (2013.01); *F04D 29/542* (2013.01)

(58) Field of Classification Search
CPC .... F04D 29/547; F04D 19/028; F04D 29/542; F04D 19/02; F04D 29/324; F01D 5/143
See application file for complete search history.

(56) References Cited

U.S. PATENT DOCUMENTS 2,991,929 A 7/1961 Stalker
3,169,747 A * 2/1965 Glenfield ..... F04D 29/544 415/119
(Continued)

FOREIGN PATENT DOCUMENTS

EP 2593642 A1 5/2013
JP S56167899 A 12/1981
(Continued)

OTHER PUBLICATIONS

PCT International Search Report and Written Opinion dated May 11, 2015 corresponding to PCT Application PCT/US2014/053345 filed Aug. 29, 2014.

*Primary Examiner* — Joseph J Dallo

(57) ABSTRACT

A controlled convergence compressor flowpath (10) configured to better distribute the limited flowpath (10) convergence within compressors (12) in turbine engines (14) is disclosed. The compressor (12) may have a flowpath (10) defined by circumferentially extending inner and outer boundaries (16, 18) that having portions in which the rate of convergence changes to better distribute fluid flow therethrough. The rate of convergence may increase at surfaces (20, 22) adjacent to roots (24) of airfoils (26) and decrease near airfoil tips (68) and in the axial gaps (28) between airfoil rows (30). In at least one embodiment, the compressor flowpath (10) between leading and trailing edges (44, 46) of a first compressor blade (42) may increase convergence moving downstream to a trailing edge (46) of the first compressor blade (42) due to increased convergence of the inner compressor surface (22). The compressor flowpath (10) between leading and trailing edges (32, 34) of a first compressor vane (36) immediately downstream from the
(Continued)

first compressor blade (42) may increase convergence moving downstream due to increased convergence of the outer compressor surface (20).

15 Claims, 2 Drawing Sheets

(51) Int. Cl.
*F04D 19/02* (2006.01)
*F04D 29/32* (2006.01)

(56) References Cited

U.S. PATENT DOCUMENTS 3,203,180 A * 8/1965 Price ..... F01D 5/027 415/115
3,240,012 A * 3/1966 Price ..... F01D 5/027 415/144
3,240,016 A * 3/1966 Price ..... F01D 5/027 60/745
3,269,119 A * 8/1966 Price ..... F01D 5/027 415/114
3,365,125 A * 1/1968 Gaubatz ..... F01D 11/001 415/110
3,494,129 A * 2/1970 Krebs ..... F02K 3/06 415/144
4,371,311 A 2/1983 Walsh
4,460,309 A 7/1984 Walsh
5,167,489 A * 12/1992 Wadia ..... B64C 11/18 415/182.1
5,397,215 A 3/1995 Spear et al.
5,447,413 A 9/1995 Maier et al.
5,791,873 A 8/1998 Kreitmeier
6,283,713 B1 9/2001 Harvey et al.
6,312,219 B1 11/2001 Wood et al.
6,312,221 B1 11/2001 Yetka et al.
6,321,221 B1 11/2001 Bieganski
6,564,555 B2 5/2003 Rice et al.
6,802,695 B2 10/2004 Haller
6,899,526 B2 5/2005 Doloresco et al.
6,921,246 B2 7/2005 Brainch et al.
7,011,495 B2 3/2006 Guemmer
7,220,100 B2 5/2007 Lee et al.
7,794,202 B2 9/2010 Borthwick et al.
7,895,840 B2 3/2011 Haller
8,562,288 B2 10/2013 Guemmer
8,591,184 B2 11/2013 Siden et al.
2004/0013520 A1 1/2004 Guemmer
2011/0052406 A1* 3/2011 Bruce ..... F01D 5/288 416/241 R
2013/0052022 A1 2/2013 Dodds et al.
2013/0156578 A1* 6/2013 Little ..... F04D 29/164 416/31
2013/0192198 A1 8/2013 Brilliant et al.
2013/0224014 A1 8/2013 Aggarwala et al.
2013/0336798 A1* 12/2013 Dutka ..... F04D 29/324 416/223 R
2016/0059365 A1* 3/2016 Reynolds ..... F01D 5/145 29/889.23
2017/0067475 A1* 3/2017 Chiu ..... F04D 29/324
2017/0067476 A1* 3/2017 Deivernois ..... F04D 29/324
2017/0067477 A1* 3/2017 Blohm ..... F04D 29/324
2017/0067478 A1* 3/2017 Schurr ..... F04D 29/324
2017/0067479 A1* 3/2017 Dutka ..... F04D 29/324
2017/0114796 A1* 4/2017 DiPietro, Jr. ..... F04D 29/544

FOREIGN PATENT DOCUMENTS

SU 953271 A1 8/1982
SU 1109065 A3 8/1984
SU 1719662 A1 3/1992

* cited by examiner

CONTROLLED CONVERGENCE COMPRESSOR FLOWPATH FOR A GAS TURBINE ENGINE

FIELD OF THE INVENTION

This invention is directed generally to turbine engines, and more particularly to a compressor flowpath within a compressor of a gas turbine engine.

BACKGROUND

Typically, gas turbine engines include a compressor for compressing air, a combustor for mixing the compressed air with fuel and igniting the mixture, and a turbine blade assembly for producing power. Compressor flowpaths have been generally constructed form conical segments, i.e. piecewise linear, that continually reduce the flowpath annulus area from inlet to outlet. These flowpaths are relatively easy to design and manufacture, however, these flowpaths do not use the flowpath convergence, i.e. area reduction, as effectively as possible, and also waste significant convergence in the vaneless or bladeless gaps, or both between compressor airfoil rows.

SUMMARY OF THE INVENTION

A controlled convergence compressor flowpath configured to better distribute the limited flowpath convergence within compressors in turbine engines is disclosed. The compressor may have a flowpath defined by circumferentially extending inner and outer boundaries that have portions in which the rate of convergence changes to better distribute fluid flow therethrough. The rate of convergence may increase at surfaces adjacent to roots of airfoils and decrease convergence near airfoil tips and in the axial gaps between airfoil rows. In at least one embodiment, the compressor flowpath between leading and trailing edges of a first compressor blade may increase convergence moving downstream to a trailing edge of the first compressor blade due to increased convergence of the inner compressor surface. In at least one embodiment, the compressor flowpath convergence may increase near the blade root moving downstream to a trailing edge of the first compressor blade aft of a point of maximum thickness of a root of the first compressor blade. The compressor flowpath between leading and trailing edges of a first compressor vane immediately downstream from the first compressor blade may increase convergence moving downstream due to increased convergence of the outer compressor surface. In at least one embodiment, the compressor flowpath convergence may increase near the vane root moving downstream to a trailing edge of the first compressor vane aft of a point of maximum thickness of the root of the first compressor vane.

In at least one embodiment, the gas turbine engine may include a compressor formed from a rotor assembly and a stator assembly. The rotor assembly may be formed from a plurality of radially outward extending compressor blades aligned into a plurality of circumferentially extending rows and wherein the rotor assembly is rotatable. The stator assembly may be formed from a plurality of radially inward extending compressor vanes aligned into a plurality of circumferentially extending rows. The stator assembly may be fixed relative to the rotatable rotor assembly. The rows of compressor vanes may alternate with the rows of compressor blades moving in a downstream direction.

An inner compressor surface may define a circumferential inner boundary surface of the compressor, and an outer compressor surface may define a circumferential outer boundary surface of the compressor whereby the inner and outer compressor surfaces form a compressor flowpath. The compressor flowpath may converge moving downstream. The compressor flowpath between a leading edge and a trailing edge of a first compressor blade may increase convergence moving downstream to a trailing edge of the first compressor blade. The compressor flowpath between the leading edge and the trailing edge of a first compressor blade may increase convergence moving downstream to the trailing edge of the first compressor blade due to increased convergence of the inner compressor surface aft of a point of maximum thickness of a root of the first compressor blade, decreased convergence of the outer compressor surface proximate to the tip of the first compressor blade, and decreased convergence in the vaneless gap downstream of the first compressor blade. In at least one embodiment, the inner compressor surface radially aligned with and between the leading edge and the trailing edge of the first compressor blade may be nonlinear. The inner compressor surface radially aligned with and between the leading edge and the trailing edge of the first compressor blade may curve radially outward moving downstream.

The compressor flowpath between the trailing edge of the first compressor blade and a leading edge of a first compressor vane immediately downstream from the first compressor blade may reduce convergence from a rate of convergence between the leading and trailing edges of the first compressor blade. In at least one embodiment, the inner compressor surface between the trailing edge of the first compressor blade and the leading edge of a first compressor vane immediately downstream from the first compressor blade may be linear. The outer compressor surface between the trailing edge of the first compressor blade and the leading edge of a first compressor vane immediately downstream from the first compressor blade may be linear.

The compressor flowpath between the leading edge and a trailing edge of the first compressor vane immediately downstream from the first compressor blade may increase convergence moving downstream relative to the rate of convergence immediately upstream. The compressor flowpath between the leading edge and the trailing edge of the first compressor vane may increase convergence moving downstream due to increased convergence of the outer compressor surface aft of a point of maximum thickness of a root of the first compressor vane. The outer compressor surface radially aligned with and between the leading edge and the trailing edge of the first compressor vane may be nonlinear. In at least one embodiment, the outer compressor surface radially aligned with and between the leading edge and the trailing edge of the first compressor vane may curve radially inward moving downstream. The compressor flowpath between the trailing edge of the first compressor vane and a leading edge of a compressor blade immediately downstream from the first compressor vane may reduce convergence from a rate of convergence between the leading and trailing edges of the first compressor vane.

Typical airfoil roots are much thicker than the airfoil tips because the airfoils are mechanically supported at the roots. The difference in root and tip thickness increases for higher aspect ratio airfoils like those that tend to occur toward the front stages of compressors. The increased thickness increases the risk of flow separation downstream of the maximum thickness point. Increasing flowpath convergence in that region reduces the risk of flow separation.

An advantage of the controlled convergence compressor flowpath is that the flowpath increases convergence adjacent to the roots of the airfoils, and more specifically, immediately aft of a point of maximum thickness of the airfoil to help prevent flow separation there. To hold overall compressor flowpath (inlet to exit) convergence constant, the increased convergence near airfoil roots is offset by reducing convergence in regions where it is less effective, such as near the tips of airfoils and in the vaneless axial gaps between airfoil rows. This results in better distribution of the limited flowpath area convergence of compressors. The typical mechanical construction of compressors requires that the maximum thickness of the vanes occur at the OD, and the maximum thickness of the blades occurs at the ID. Application of the controlled convergence flowpath then results in an oscillating pattern. Along the flowpath ID, convergence is increased at the blade roots and decreased at the vane tips. Along the flowpath OD, convergence is decreased at the blade tips and increased at the vane roots.

Another advantage of the controlled convergence compressor flowpath is that the convergence of the flowpath is distributed in a non-linear manner such that it mostly occurs aft of a location of the root airfoil maximum thickness. Such a configuration reduces the peak mach number and diffusion loading on airfoils near the root, which reduces losses and increases efficiency.

Still another advantage of the controlled convergence compressor flowpath is that the flowpath transitions from linear convergence over the airfoil tips to non-linear convergence over the airfoil roots.

Another advantage of the controlled convergence compressor flowpath is that reduced convergence due to a reduced slope over the blade tips can improve clearances by improving tolerances, which creates less uncertainty than in steeper slopes, and reduces the effect of rotor axial displacements.

Yet another advantage of the controlled convergence compressor flowpath is that the flowpath shape reduces the flowpath convergence, i.e. the slope, in the vaneless axial gap between the airfoil rows to reduce area convergence because no diffusion occurs at that location within the compressor, which allows more convergence to be applied within the airfoil envelopes where all of the flow diffusion occurs.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
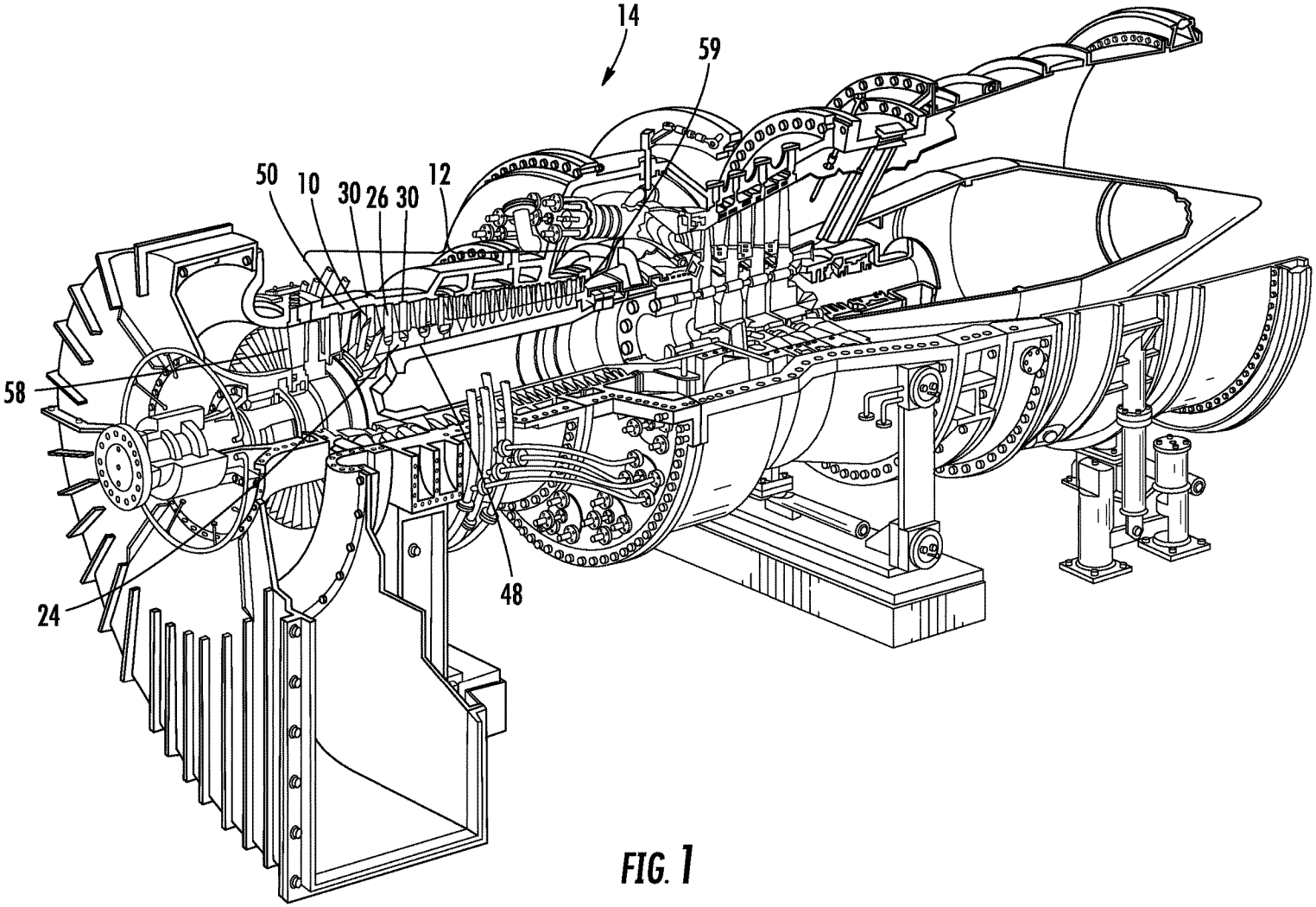
FIG. 1 is a perspective view of a gas turbine engine with a partial cross-sectional view with a compressor.
Figure 2:
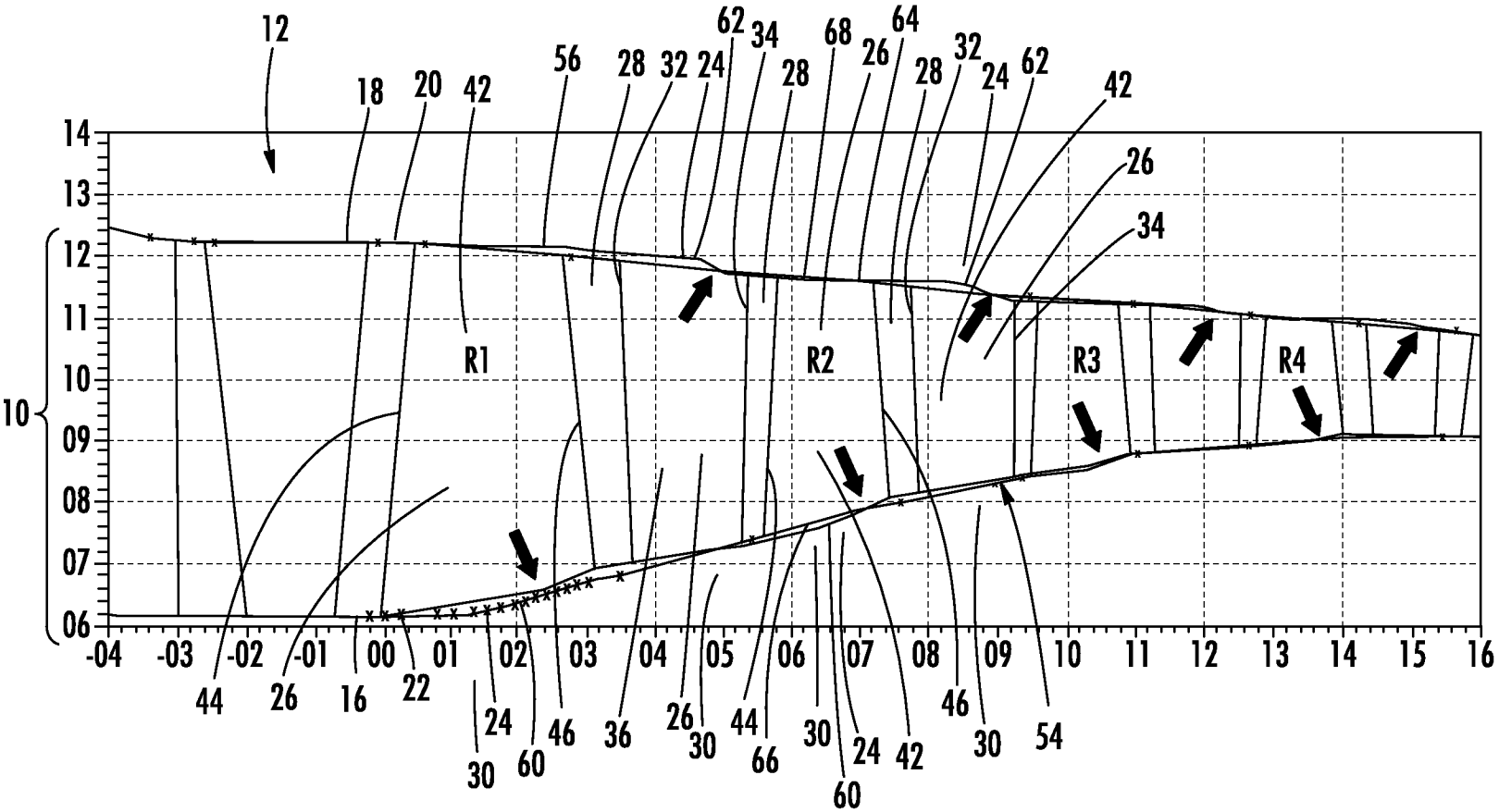
FIG. 2 is a cross-sectional side view of a portion of the compressor

As shown in FIGS. 1-2, a controlled convergence compressor flowpath 10 configured to better distribute the limited flowpath convergence within compressors 12 in turbine engines 14 is disclosed. The compressor 12 may have a flowpath 10 defined by circumferentially extending inner and outer boundaries 16, 18 that have portions in which the rate of convergence changes to better distribute fluid flow therethrough. The rate of convergence may increase at surfaces 20, 22 adjacent to roots 24 of airfoils 26 and decrease near airfoil tips 68 and in the axial gaps 28 between airfoil rows 30. In at least one embodiment, the rate of convergence may increase at surfaces 20, 22 adjacent to roots 24 of airfoils 26 and aft of a location of maximum thickness of the roots 24 and may reduce convergence near airfoil tips 68 and in the axial gaps 28 between airfoil rows 30. In at least one embodiment, the compressor flowpath 10 between leading and trailing edges 44, 46 of a first compressor blade 42 may increase convergence moving downstream to the trailing edge 46 of the first compressor blade 42 due to increased convergence of an inner compressor surface 22 aft of a point 60 of maximum thickness of a root 24 of the first compressor blade 42. The compressor flowpath 10 within the vaneless axial gap 28 between rows 30 of compressor blades 42 and rows 30 of compressor vanes 36 may have reduced convergence compared to the row 30 of compressor blades 42 immediately upstream. The compressor flowpath between leading and trailing edges 32, 34 of a first compressor vane 36 immediately downstream from the first compressor blade 42 may increase convergence moving downstream relative to the axial gap 28 upstream of the first compressor vane 36 due to increased convergence of the outer compressor surface 20 aft of a point 62 of maximum thickness of a root 24 of the first compressor vane 36.

In at least one embodiment, the gas turbine engine 14 may include one or more compressors 12 formed from a rotor assembly 48 and a stator assembly 50. The rotor assembly 48 may be formed from a plurality of radially outward extending compressor blades 42 aligned into a plurality of circumferentially extending rows 30. The rotor assembly 48 may be rotatable about an axis of the turbine engine 14. The stator assembly 50 may be formed from a plurality of radially inward extending compressor vanes 36 aligned into a plurality of circumferentially extending rows 30. The stator assembly 50 may be fixed relative to the rotatable rotor assembly 48. The rows 30 of compressor vanes 36 may alternate with the rows 30 of compressor blades 42 moving in a downstream direction.

The inner compressor surface 22 may define a circumferential inner boundary surface 54 of the compressor 12, and the outer compressor surface 20 may define a circumferential outer boundary surface 56 of the compressor 12 whereby the inner and outer compressor surfaces 22, 20 form the compressor flowpath 10. The compressor flowpath 10 may converge moving downstream from an inlet 58 of the compressor 12 to an outlet 59.

In at least one embodiment, the compressor flowpath 10 radially outward of, such as at the OD, and between the leading edge 44 and the trailing edge 46 of one or more first compressor blades 42 forming a row 30 of compressor blades 42, otherwise known as a stage when positioned adjacent a row of turbine vanes, may increase convergence moving downstream to the trailing edge 46 of the first compressor blade 42 relative to a rate of convergence immediately upstream from the first compressor blade 42. In at least one embodiment, the compressor flowpath 10 radially outward of and between the leading edge 44 and the trailing edge 46 of the first compressor blade 42 may increase convergence moving downstream to the trailing edge 44 of the first compressor blade 42 due to increased convergence of the inner compressor surface 22 aft of a point 60 of maximum thickness of a root 24 of the first compressor blade 42. The slope of convergence of the controlled convergence compressor flowpath 10 proximate to a blade tip 68 at the OD 64 may be reduced and the slope of convergence may be increased proximate to the airfoil root at the ID 66 so that, at the location of largest thickness of the blade 42 near the root, the convergence of the flowpath increases to prevent flow separation from occurring aft of the airfoil maximum thickness point. Blade tips 68 are typically thinner than blade roots, thus area convergence within the blade row 30 is less effective proximate to the blade tip 68. The inner compressor surface 22 radially aligned with and between the leading edge 44 and the trailing edge 46 of the first compressor blade 42 may be nonlinear. In at least one embodiment, the inner compressor surface 22 radially aligned with and between the leading edge 44 and the trailing edge 46 of the first compressor blade 42 curves radially inward moving downstream.

The compressor flowpath 10 in the axial gap 28 radially outward of and between the trailing edge 46 of the first compressor blade 42 and the leading edge 32 of a first compressor vane 36 immediately downstream from the first compressor blade 42 reduces convergence from a rate of convergence between the leading and trailing edges 44, 46 of the first compressor blade 42. In at least one embodiment, the rate of convergence in the vaneless axial gaps 28 between the compressor blades 42 and compressor vanes 36 at the inner compressor surface 22 and at the outer compressor surface 20 may be equal. In at least one embodiment, the inner compressor surface 22 between the trailing edge 46 of the first compressor blade 42 and the leading edge 32 of a first compressor vane 36 immediately downstream from the first compressor blade 42 may be linear. The outer compressor surface 20 between the trailing edge 46 of the first compressor blade 42 and the leading edge 32 of a first compressor vane 36 immediately downstream from the first compressor blade 42 may be linear.

The compressor flowpath 10 between the leading edge 32 and the trailing edge 34 of the first compressor vane 36 immediately downstream from the first compressor blade 42 may increase convergence moving downstream. In at least one embodiment, the compressor flowpath 10 between the leading edge 32 and the trailing edge 34 of the first compressor vane 36 may increase convergence moving downstream due to increased convergence of the outer compressor surface 20 aft of a point 62 of maximum thickness of a root 24 of the first compressor vane 36. The outer compressor surface 20 radially aligned with and between the leading edge 32 and the trailing edge 34 of the first compressor vane 36 may be nonlinear. In at least one embodiment, the outer compressor surface 20 radially aligned with and between the leading edge 32 and the trailing edge 34 of the first compressor vane 36 may curve radially inward moving downstream, thereby increasing convergence. The compressor flowpath 10 between the trailing edge 34 of the first compressor vane 36 and a leading edge 44 of a compressor blade immediately downstream from the first compressor vane 36 reduces convergence from a rate of convergence between the leading and trailing edges 32, 34 of the first compressor vane 36.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A gas turbine engine comprising:

a compressor formed from a rotor assembly and a stator assembly;

wherein the compressor comprises an inner compressor surface and an outer compressor surface;

wherein the rotor assembly is formed from a plurality of radially outward extending compressor blades from the inner compressor surface aligned into a plurality of circumferentially extending rows and wherein the rotor assembly is rotatable;

wherein the stator assembly is formed from a plurality of radially inward extending compressor vanes from the outer compressor surface aligned into a plurality of circumferentially extending rows, wherein the stator assembly is fixed relative to the rotatable rotor assembly and wherein the rows of compressor vanes alternate with the rows of compressor blades moving in a downstream direction;

wherein the inner and outer compressor surfaces form a compressor flowpath;

wherein the compressor flowpath converges moving downstream;

wherein a rate of the convergence of the compressor flowpath increases at the inner and outer surfaces adjacent to roots of the blades and vanes; and wherein the rate of the convergence of the compressor flowpath reduces at the inner and outer surfaces adjacent to tips of the blades and vanes.

2. The gas turbine engine of claim 1, wherein the rate of the convergence of the compressor flowpath at the inner compressor surface between a leading edge and a trailing edge of a first compressor blade increases aft of a point of maximum thickness of a root of the first compressor blade.

3. The gas turbine engine of claim 1, wherein the rate of the convergence of the compressor flowpath at the inner compressor surface radially aligned with and between a leading edge and a trailing edge of a first compressor blade is nonlinear.

4. The gas turbine engine of claim 1, wherein the rate of the convergence of the compressor flowpath at the inner compressor surface radially aligned with and between a leading edge and a trailing edge of a first compressor blade curves radially inward moving downstream.

5. The gas turbine engine of claim 1, wherein the rate of the convergence of the compressor flowpath at the inner compressor surface between a trailing edge of a first compressor blade and a leading edge of a first compressor vane immediately downstream from the first compressor blade is linear.

6. The gas turbine engine of claim 1, wherein the rate of the convergence of the compressor flowpath at the outer compressor surface between a trailing edge of a first compressor blade and a leading edge of a first compressor vane immediately downstream from the first compressor blade is linear.

7. The gas turbine engine of claim 1, wherein the rate of the convergence of the compressor flowpath at the outer compressor surface between a leading edge and a trailing edge of a first compressor vane immediately downstream from a first compressor blade increases moving downstream.

8. The gas turbine engine of claim 1, wherein the rate of the convergence of the compressor flowpath at the outer compressor surface between a leading edge and a trailing edge of a first compressor vane increases moving downstream due to increased convergence of the outer compressor surface.

9. The gas turbine engine of claim 1, wherein the rate of the convergence of the compressor flowpath at the outer compressor surface between a leading edge and a trailing edge of a first compressor vane increases aft of a point of maximum thickness of a root of the first compressor vane.

10. The gas turbine engine of claim 1, wherein the rate of the convergence of the compressor flowpath at the inner compressor surface between a leading edge and a trailing edge of a first compressor vane reduces radially inwardly.

11. The gas turbine engine of claim 1, wherein the rate of the convergence of the compressor flowpath at the outer compressor surface radially aligned with and between a leading edge and a trailing edge of a first compressor vane is nonlinear.

12. The gas turbine engine of claim 1, wherein the rate of the convergence of the compressor flowpath at the outer compressor surface radially aligned with and between a leading edge and a trailing edge of a first compressor vane curves radially inward moving downstream.

13. The gas turbine engine of claim 1, wherein the rate of the convergence of the compressor flowpath at the outer compressor surface between a trailing edge of a first compressor vane and a leading edge of a compressor blade immediately downstream from the first compressor vane reduces from the rate of the convergence of the compressor flowpath at the outer compressor surface between a leading edge and the trailing edge of the first compressor vane.

14. The gas turbine engine of claim 1, wherein the rate of the convergence of the compressor flowpath at the inner compressor surface between a trailing edge of a first compressor blade and a leading edge of a first compressor vane immediately downstream from the first compressor blade reduces from the rate of the convergence of the compressor flowpath at the inner compressor surface between a leading edge and the trailing edge of the first compressor blade.

15. The gas turbine engine of claim 1, wherein the rate of the convergence of the compressor flowpath at the inner and outer surfaces transitions from linear over the tips of the blades and vanes to nonlinear over the roots of the blades and vanes.

* * * * *